US006644359B1

(12) United States Patent
Wertheim

(10) Patent No.: US 6,644,359 B1
(45) Date of Patent: Nov. 11, 2003

(54) TAMPER-PROOF CHEMICAL DISPENSING DEVICE FOR HIGH SECURITY ENVIRONMENTS

(75) Inventor: Mark S Wertheim, Danville, CA (US)

(73) Assignee: Keene Sanitary Supply, Inc., San Leandro, CA (US)

( * ) Notice: Subject to any disclaimer, the term of this patent is extended or adjusted under 35 U.S.C. 154(b) by 0 days.

(21) Appl. No.: 10/121,303

(22) Filed: Apr. 11, 2002

Related U.S. Application Data

(63) Continuation-in-part of application No. 09/828,554, filed on Apr. 5, 2001, now Pat. No. 6,439,272.

(60) Provisional application No. 60/262,733, filed on Jan. 19, 2001, and provisional application No. 60/194,811, filed on Apr. 5, 2000.

(51) Int. Cl.[7] ..... B65B 1/04

(52) U.S. Cl. ..... 141/2; 141/18; 141/9; 141/100; 222/538

(58) Field of Search ..... 141/2, 18, 98, 141/9, 100, 104, 94; 222/538, 132, 145.1, 145.4, 145.5, 129, 135, 153.01, 153.02, 153.03, 153.13, 153.14, 173, 182, 183, 540, 566, 572, 573, 575

(56) References Cited

U.S. PATENT DOCUMENTS

| | | | |
|---|---|---|---|
| 932,386 | A | 8/1909 | Gross |
| 1,075,999 | A | 10/1913 | Abramovitz |
| 1,291,566 | A | 1/1919 | Lewis |
| 1,366,529 | A | 1/1921 | Frick |
| 1,421,765 | A | 7/1922 | Cunningham |
| 1,715,939 | A | 6/1929 | Milestone |
| 2,000,556 | A | 5/1935 | Brady |
| 2,063,171 | A | 12/1936 | Kucher |
| 2,512,395 | A | 6/1950 | Sundberg |
| 2,572,541 | A | 10/1951 | Thompson et al. |
| 2,643,669 | A | 6/1953 | Logan |
| 3,127,065 | A | 3/1964 | Stevenson |

(List continued on next page.)

FOREIGN PATENT DOCUMENTS

| | | |
|---|---|---|
| DE | 2558509 | 5/1976 |
| DE | 2558569 | 5/1976 |
| GB | 2173476 A | 10/1986 |

OTHER PUBLICATIONS

Photographs of mixing nozzle by Advance Chemical Company, Huntington Beach, CA, (no date).

Aurora Laboratories, Inc. (2001). *Secure Dispensing Units*. Retreived Mar. 14, 2003 from *http://www.auroralaboratories.com/secure.html*.

(List continued on next page.)

*Primary Examiner*—Steven O. Douglas
(74) *Attorney, Agent, or Firm*—Thomas P. Lebens; Fitch, Even, Tabin & Flannery

(57) ABSTRACT

The present invention can be characterized as a tamper proof apparatus for dispensing a selected liquid such as a cleaning product in a environment where protection against abuse and vandalism is desired. The tamper proof apparatus includes a cabinet enclosure having an open front for accessing interior components; a hinged faceplate covering the open front of the cabinet enclosure; a mixing unit fastened to an inside surface of the hinged faceplate for dispensing the selected liquid; a filling recess formed in the hinged faceplate for limiting a dimension of a container placed inside the filling recess; a filling nozzle coupled to the mixing unit for dispensing the selected liquid into the container placed inside the filling recess; a pushbutton coupled to the mixing unit through the hinged faceplate for causing the selected liquid to be dispensed through the filling nozzle; and a locking plate that may be detachably coupled to the hinged faceplate for restricting access to the pushbutton individually.

33 Claims, 8 Drawing Sheets

U.S. PATENT DOCUMENTS

| | | | |
|---|---|---|---|
| 3,195,777 | A | 7/1965 | Hart |
| 3,861,568 | A | 1/1975 | Morris et al. |
| 3,940,019 | A | 2/1976 | Kross et al. |
| 3,945,603 | A | 3/1976 | Fraser |
| 4,120,181 | A | 10/1978 | Stubbings |
| 4,158,426 | A | 6/1979 | Frohbieter |
| 4,911,212 | A | 3/1990 | Burton |
| 5,060,689 | A | 10/1991 | Csaszar et al. |
| 5,064,097 | A | 11/1991 | Brog et al. |
| 5,088,621 | A | 2/1992 | Thompson et al. |
| 5,255,820 | A | 10/1993 | Thomas |
| 5,333,467 | A | 8/1994 | Pearl, II et al. |
| 5,344,074 | A | 9/1994 | Spriggs et al. |
| 5,351,875 | A | 10/1994 | Rhine et al. |
| 5,584,327 | A | 12/1996 | Thomas et al. |
| 5,651,398 | A | 7/1997 | Decker et al. |
| 6,302,163 | B1 | 10/2001 | Zeigler |
| 6,439,272 | B1 | 8/2002 | Wertheim |

OTHER PUBLICATIONS

Aurora Laboratories, Inc. Product Bulletin. Micro–Clean Security Cabinent, (no date).

Aurora Laboratories, Inc. Product Bulletin. *Micro–Clean System*, (no date).

Aurora Laboratories, Inc. Product Invoice. Invoice No. 051310. Jan. 26, 1999.

Knight, Inc. Product Catalog. *Proportioning Systems*, (no date).

Knight LLC. Retreived Mar. 14, 2003 from http://www.knightequip.com/index.htm.

Hydro Systems Co. Proportioning and Dispensing Systems, (no date).

Hydro Systems Co. Products. Retreived Mar. 14, 2003 from *http://www.hydrosystemsco.com/homeq.htm*.

Hydro Systems Co. Product Catalog. (1997). *Proportioning and Dispensing Systems*.

DEMA Engineering. *Chemical Dispensers*. Retreived Mar. 14, 2003 from *http://demaeng.com/chemDisp.html*.

DEMA Engineering Company. Company Bulletin, (no date).

DEMA Engineering Product Catalog. Lockable Blend Safe, (no date).

Dilution Control Chemicals & Systems Product Catalog. Waxie Solution Station, pg. 9, (no date).

Dilution Control Chemicals & Systems Product Catalog. Butcher's Command Center, pg. 16, (no date).

U.S. Chemicals Corporation. One Shot Cleaners Product Application Guide, 2002.

Brightwell Product Summary. Chemical Concentrate Dispensers. May 2002.

Champion Chemical Co., Janitorial Product Line. Whittier, CA, (no date).

Photographs of Secure Chemical Dispensers by Champion Chemical Co., Whittier, CA, (no date).

3M Product Brochure. CompuBlend II cleaning chemical management system, (no date).

Keene Sanitary Supply Cleaning Map. Cell and Second Tier Cleaning, (no date).

Keene Sanitary Supply Product Brochure. OPS Boxx Maximum Security Dispenser System, (no date).

Keene Sanitary Supply Product Brochure. OPS Dial–A–Color Cleaning Solution Dispensing System, (no date).

Keene Sanitary Supply Product Brochure. OPS Dial–A–Color Squeeze–N–Go Supreme, (no date).

Keene Sanitary Supply, Inc. v. Champion Chemical Company of California, Inc., U.S. District Court For The Central District Of California. Case No. 028148 TJH (Cwx). Declaration of Mike Jean In Opposition To Plaintiff's Motion For Preliminary Injunction. Mar. 6, 2003.

Keene Sanitary Supply, Inc., v. Champion Chemical Company Of California, Inc. U.S. District Court For The Central District of California. Case No. 028148 TJH (Cwx). Declaration Of David Ellis In Opposition To Plaintiff's Motion For Preliminary Injunction. Mar. 6, 2003.

Keene Sanitary Supply, Inc. v. Champion Chemical Company Of California, Inc., U.S. District Court For The Central District of California. Case No. 028148 TJH (Cwx). Declaration of Frank Winslow. Mar. 11, 2003.

Keene Sanitary Supply, Inc., v. Champion Chemical Company of California, Inc. U.S. District Court For The Central District Of California. Case No. 028148 TJH (Cwx). Defendant Champion's Evidentiary Objections To The Declaration Of Mark S. Wertheim Injunction. Mar. 10, 2003.

Keene Sanitary Supply, Inc., v. Champion Chemical Company of California, Inc. U.S. District Court For The Central District Of California. Case No. 028148 TJH (Cwx). Memorandum of Points and Authorities in Opposition To Plaintiff's Motion For Preliminary Injunction. Mar. 10, 2003.

TAMPER-PROOF CHEMICAL DISPENSING DEVICE FOR HIGH SECURITY ENVIRONMENTS

CROSS REFERENCE TO RELATED APPLICATIONS

This patent document is a continuation-in-part of and claims priority under 35 U.S.C. § 120 to U.S. patent application No. 09/828,554 for TAMPER-PROOF CHEMICAL DISPENSING DEVICE FOR HIGH SECURITY ENVIRONMENTS, filed Apr. 5, 2001, U.S. Pat. No. 6,439,554 by Mark Wertheim, now U.S. Pat. No. 6,439,272, which is a nonprovisional of and claims priority under 35 U.S.C. § 119(e) to U.S.

Provisional Patent Application No. 60/262,733 for TAMPER-PROOF CHEMICAL DISPENSING DEVICE FOR HIGH SECURITY ENVIRONMENTS, filed Jan. 19, 2001, by Mark Wertheim; to U.S. Provisional Patent Application No. 60/194,811 for TAMPER-PROOF CHEMICAL DISPENSING DEVICE FOR HIGH SECURITY ENVIRONMENTS, filed Apr. 5, 2000, by Mark Wertheim.

This patent document is also a continuation-in-part of and claims priority under 35 U.S.C. § 120 to U.S. patent application No. 09/922,963 for TAMPER-PROOF CHEMICAL DISPENSING DEVICE FOR HIGH SECURITY ENVIRONMENTS, filed Aug. 3, 2001, by Mark Wertheim, which is a nonprovisional of and claims priority under 35 U.S.C. § 119(e) to U.S. Provisional Patent Application No. 60/262,733 for TAMPER-PROOF CHEMICAL DISPENSING DEVICE FOR HIGH SECURITY ENVIRONMENTS, filed Jan. 19, 2001, by Mark Wertheim.

This patent document relates to and expressly incorporates by reference U.S. Provisional Patent Application No. 60/194,811 for TAMPER-PROOF CHEMICAL DISPENSING DEVICE FOR HIGH SECURITY ENVIRONMENTS, filed Apr. 5, 2000, by Mark Wertheim; U.S. Provisional Patent Application No. 60/262,733 for TAMPER-PROOF CHEMICAL DISPENSING DEVICE FOR HIGH SECURITY ENVIRONMENTS, filed Jan. 19, 2001, by Mark Wertheim; U.S. patent application No. 09/828,554 for TAMPER-PROOF CHEMICAL DISPENSING DEVICE FOR HIGH SECURITY ENVIRONMENTS, filed Apr. 5, 2001, by Mark Wertheim; and to U.S. patent application No. 09/922,963 for TAMPER-PROOF CHEMICAL DISPENSING DEVICE FOR HIGH SECURITY ENVIRONMENTS, filed Aug. 3, 2001, by Mark Wertheim.

BACKGROUND OF THE INVENTION

The present invention is directed to methods and apparatus for dispensing liquids. More specifically, but without limitation thereto, the present invention is directed to dispensing cleaning products from a tamper proof container suitable for use in a jail, a correctional facility, a school, a public facility, or any other location where an apparatus for dispensing liquids may be subject to abuse and vandalism.

Liquid and soap dispensers have been used for many years. These dispensers are used in a number of applications, including: soap dispensers in restrooms, beverage dispensers, liquid dispensers at gas stations, etc. However, these devices are limited in their ability to prevent dispensing potentially dangerous and expensive liquids to unauthorized personnel.

SUMMARY OF THE INVENTION

In one embodiment, the present invention may be characterized as a tamper proof liquid dispenser that includes a cabinet enclosure having an open front for accessing interior components; a hinged faceplate covering the open front of the cabinet enclosure; a mixing unit fastened to an inside surface of the hinged faceplate for dispensing the selected liquid; a filling recess formed in the hinged faceplate for limiting a dimension of a container placed inside the filling recess; a filling nozzle coupled to the mixing unit for dispensing the selected liquid into the container placed inside the filling recess; a pushbutton coupled to the mixing unit through the hinged faceplate for causing the selected liquid to be dispensed through the filling nozzle; and a locking plate that may be detachably coupled to the hinged faceplate for restricting access to the pushbutton individually.

In another embodiment, the present invention may be characterized as a tamper proof liquid dispenser that is mounted on a wall to allow limited clearance for dispensing liquid into a container placed underneath, such as a mop bucket, while preventing filling of a larger container such as a garbage can.

In a further embodiment, the present invention may be characterized as a tamper proof liquid dispenser that includes a triple basin sink mounted underneath a tamper proof apparatus for dispensing a first liquid mixture, such as a soap mixture, into a first basin and a second liquid mixture, such as a sterilizer mixture, into a third basin of the triple basin sink.

DESCRIPTION OF THE DRAWINGS

The present invention is illustrated by way of example and not limitation in the accompanying figures, in which like references indicate similar elements throughout the several views of the drawings, and in which.

Elements in the figures are illustrated for simplicity and clarity and have not necessarily been drawn to scale. For example, the dimensions of some of the elements in the figures may be exaggerated relative to other elements to help to improve understanding of the following description of the illustrated embodiments.

DESCRIPTION OF THE ILLUSTRATED EMBODIMENTS

Figure 1:
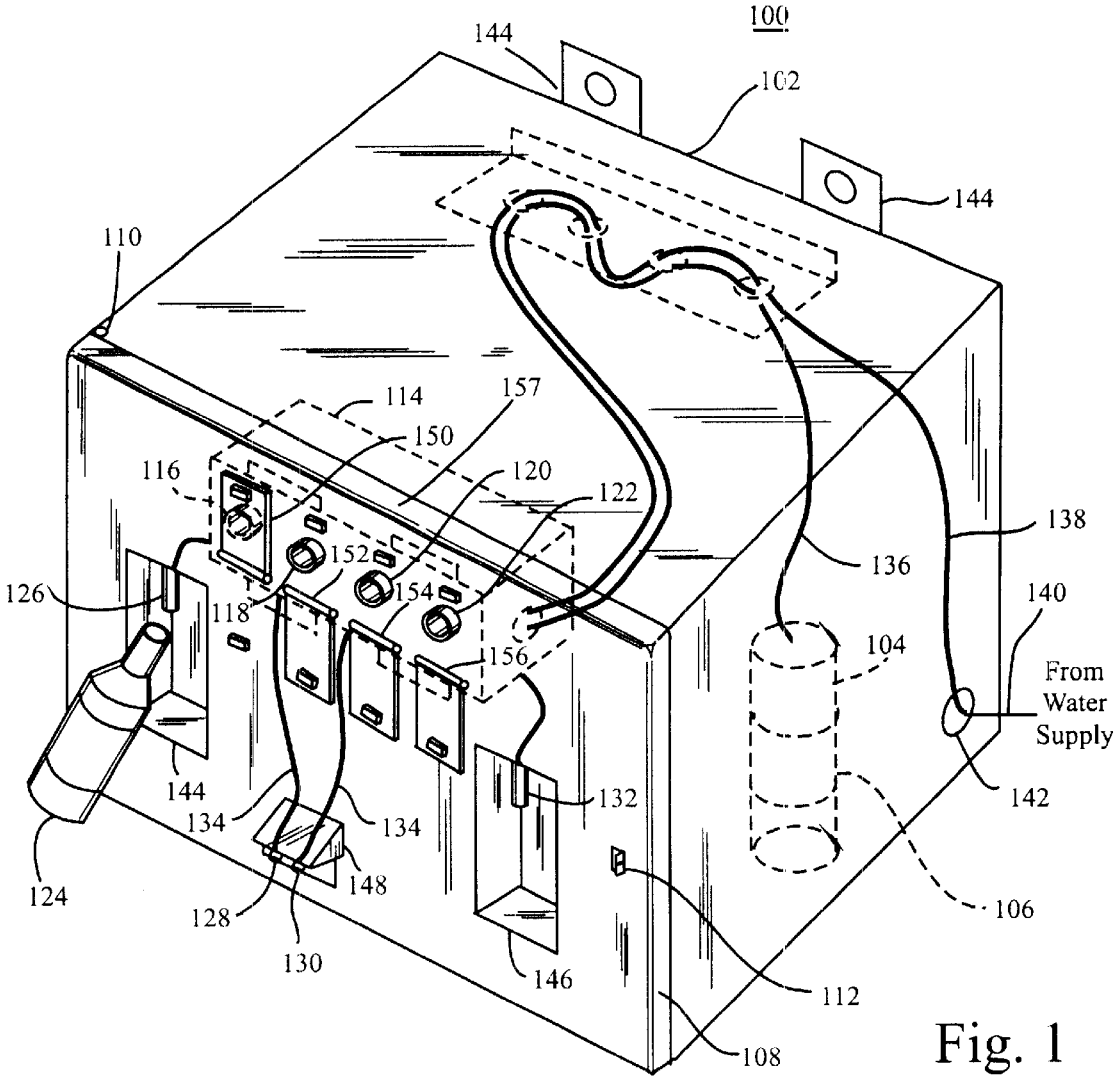
FIG. 1 illustrates a tamper proof liquid dispenser for use with soap and other cleaning products including chemical liquids according to an embodiment of the present invention.

FIG. 1 illustrates a tamper proof liquid dispenser 100 according to an embodiment of the present invention for use with soap and other cleaning products including chemical liquids. Shown in FIG. 1 are a cabinet enclosure 102, a product container 104, a liquid chemical product 106, a hinged faceplate 108, a tamper proof hinge 110, a faceplate clasp 112, a mixing unit 114, pushbuttons 116, 118, 120, and 122, a dispensing container 124, filling nozzles 126, 128, 130, and 132, output lines 134, supply lines 136 and 138, a liquid solvent 140, a feedthrough 142, filling recesses 144 and 146, an outlet shield 148, locking plates 150, 152, 154, and 156, a strain relief 158, and wall mounting brackets 144.

The cabinet enclosure 102 is used to store one or more product containers 104, each containing a liquid chemical product 106, such as a cleaning product concentrate; and to protect the liquid chemical product 106 in environments where the liquid chemical product 106 may be subject to unauthorized access, abuse, and vandalism. The hinged faceplate 108 covers the open front of the cabinet enclosure 102. The hinged faceplate 108 is preferably secured to the cabinet enclosure 102 by the tamper proof hinge 110 on one side and by the faceplate clasp 112 on the opposite side. The faceplate clasp 112 is secured to the inside of cabinet enclosure 102 and protrudes through a slot in the hinged faceplate 108 to prevent opening the enclosure cabinet 102 by means other than by unlocking a padlock (not shown) or other suitable lock from the faceplate clasp 112. The hinged faceplate 108 swings on the tamper proof hinge 110 away from the front of the cabinet enclosure 102 to allow access to one or more of the product containers 104 and other components inside the cabinet enclosure 102. Other well-known locking arrangements may be used in alternative embodiments of the present invention to secure the hinged faceplate 108 to the cabinet enclosure 102 to prevent unauthorized access inside the cabinet enclosure 102.

The mixing unit 114 is mounted on the inside of the hinged faceplate 108 so that the pushbuttons 116, 118, 120, and 122 are accessible from the outside of the hinged faceplate 108 through holes formed in the faceplate 108 around each of the pushbuttons 116, 118, 120, and 122. The pushbuttons 116, 118, 120, and 122 may be recessed into the faceplate and shielded by cylindrical walls welded or otherwise fastened to the faceplate and/or the mixing unit 114 to enclose each of the pushbuttons 116, 118, 120, and 122 for further protection against tampering. The pushbuttons 116, 118, 120, and 122 each activate a valve (not shown) inside the mixing unit 114 to dispense a separate mixture of the selected liquid chemical product 106 and the solvent 140 into the dispensing container 124 placed under one of the filling nozzles 126, 128, 130, and 132. By way of example, a separate mixture of one of four separate liquid chemical products 106 from each of four product containers 104 may be selected in response to depressing a corresponding one of the pushbuttons 116, 118, 120, and 122. The mixture of the selected liquid chemical product 106 is dispensed from the mixing unit 114 through the output line 134 connected to the corresponding one of the filling nozzles 126, 128, 130, and 132. In this manner each of the pushbuttons 116, 118, 120, and 122 can select a different mixture of a liquid chemical product from the same product container 104 or a different liquid chemical product from a separate product container 104. The product containers 104 may be, for example, bottles made of glass, metal, or plastic. In various embodiments, the product containers 104 may be plastic kegs having security plugs to prevent spills. The product containers 104 may also be inexpensive, disposable bladders made of a leakproof, flexible material and packaged in cardboard boxes. The flexible bladder collapses as the liquid chemical product 106 is drawn into the mixing unit 114 so that little or no air is allowed to enter the supply lines 136 or the flexible bladder.

Other embodiments of the present invention may be practiced having a different number of pushbuttons and filling nozzles to suit specific applications. In the illustrated example, the left two pushbuttons 116 and 118 are preferably used with the left filling nozzles 126 and 128, while the right two pushbuttons 120 and 122 are used with the right filling nozzles 130 and 132 to simplify associating the pushbuttons 116, 118, 120, and 122 with the corresponding one of the filling nozzles 126, 128, 130, and 132. Other arrangements for associating the pushbuttons 116, 118, 120, and 122 with the filling nozzles 126, 128, 130, and 132 may be made simply by changing the output lines 134 that connect the mixing unit 114 to the filling nozzles 126, 128, 130, and 132.

In the illustrated embodiment, separate locking plates 150, 152, 154, and 156 are fastened to the faceplate 108 or, alternatively, to a top 157 of the cabinet enclosure 102 on hinges that allow any one of the separate locking plates 150, 152, 154, and 156 to swing over a corresponding upper or lower clasp independently from the other locking plates. Each of the locking plates 150, 152, 154, and 156 has a slot that fits over the upper clasp in the closed position and over the lower clasp in the open position. The clasps are secured to the faceplate 108 by well known techniques, for example, by welding. The locking plates 150, 152, 154, and 156 restrict access to each of the recessed pushbuttons 116, 118, 120, and 122 individually by covering or uncovering a corresponding hole in the faceplate 108. In this example, the locking plates 152, 154, and 156 are shown in the open position over the lower clasps to allow access to the pushbuttons 118, 120, and 122. The locking plate 150 is shown in the closed position over the upper clasp to cover the hole over the pushbutton 116. In this way, each of the locking plates 150, 152, 154, and 156 restricts access to a corresponding one of the recessed pushbuttons 116, 118, 120, and 122 so that any combination of pushbuttons may be accessed by keys for the corresponding locks (not shown) used to secure the locking plates 150, 152, 154, and 156 to the upper and lower clasps. For example, a supervisor may have keys to locks for all of the locking plates 150, 152, 154, and 156, while each custodian may have a key to only one lock for dispensing only the specific cleaning product needed to perform his assigned duties. In other applications, one custodian may have keys to access two pushbuttons, another custodian may have keys to access three pushbuttons, and so on. Alternatively, identical keying arrangements may be used for various combinations of locks, so that one key opens one combination of locks, while another key opens another combination of locks. Each combination of locks may also include one or more locks belonging to one or more of the other combinations.

The chemical supply line 136 conducts one of the liquid chemical products 106 from the product container 104 to the mixing unit 114. The liquid chemical product 106 may be, for example, a cleaning product concentrate supplied from one or more of the product containers 104 stored in the cabinet enclosure 102. The solvent supply line 138 conducts the solvent 140, such as water supplied under municipal pressure, through the feedthrough 142. Only one chemical supply line 136 and one product container 104 are shown in the example of FIG. 1 to more clearly illustrate the relationships among the interior components of the cabinet enclosure 102. In practice, each of the valves in the mixing unit 114 would generally be connected by a chemical supply line 136 to a product container 104 inside the cabinet enclosure 102.

A flow tip may be inserted in the chemical supply line 136 between the mixing unit 114 and the product container 104 for controlling the flow rate of the liquid chemical product 106 through the chemical supply line 136. Different flow tips having different inside diameters may be used to select a desired solution strength. The flow tip may be inserted into the mixing unit 114 at one end and into the chemical supply line 136 at the other end, or the flow tip may be inserted into the chemical supply line 136 at one end and into a cap in the top of the product container 104 at the other end. In a preferred embodiment, the chemical supply line 136 is cut between the mixing unit 114 and the product container 104 and a double end barb coupler is inserted into the upper section of the chemical supply line 136. The double end barb is preferably secured to the upper section of the chemical supply line 136 by a hose clamp, for example, a nylon tie, to prevent the double end barb from being pulled out of the upper section of the chemical supply line 136. The flow tip is inserted into the lower end of the double end barb coupler, and the lower section of the chemical supply line 136 is inserted over the lower end of the double end barb coupler. The flow tip may then be easily removed for cleaning or replacement by pulling the lower section of the chemical supply line 136 off the lower end of the double end barb coupler, removing the flow tip from the lower end of the double end barb coupler, inserting the replacement flow tip, and inserting the lower section of the chemical supply line 136 over the lower end of the double end barb coupler.

The filling nozzles 126 and 132 protrude into the filling recesses 144 and 146. The filling recesses 144 and 146 are formed in the hinged faceplate 108 to limit at least one dimension, typically the width, of the dispensing container 124 that may be placed underneath the filling nozzles 126 and 132. The dispensing container 124 may be, for example, a spray bottle. In other embodiments, the filling recesses 144 and 146 may limit both the height and the width of the dispensing container 124, that is, the entire dispensing container 124 fits inside a filling recess. The shape of the filling recesses 142 and 144 may also be customized to accommodate only a specific dispensing container 124. This feature reduces the risk of accidentally dispensing the liquid chemical products 106 into improper containers.

The filling nozzles 128 and 130 are located at the bottom of the hinged faceplate 104 for dispensing one of two liquid chemical products 106 into a container placed beneath the cabinet enclosure 102. Alternatively, a Y-connector may be used in the output lines 134 to dispense more than one mixture of one or more liquid chemical products 106 from a single filling nozzle. Y-connectors may also be used to connect supply lines from multiple product containers 104 to a single valve in the mixing unit 114 for dispensing a mixture of multiple liquid chemical products 106. The filling nozzles 128 and 130 are protected from accidental damage or abuse by the outlet shield 148, which may be, for example, a curved triangular plate or conic section welded to the hinged faceplate 108 over the filling nozzles 128 and 130. The filling nozzles 126, 128, 130, and 132 are preferably rigid metal tubes welded to the hinged faceplate 108 to protect the output lines 134 and other interior components from abuse.

The mixing unit 114 mixes the liquid solvent 140 with one of the liquid chemical products 106 from the product container 104 in a selected proportion. When one of the pushbuttons 116, 118, 120, and 122 is depressed, the liquid chemical product 106 is drawn through the supply line 136 to the mixing unit 114. Inside the mixing unit 114, the liquid chemical product 106 is mixed with a selected proportion of the liquid solvent 140. The pressure applied to the liquid solvent 140, for example, municipal water pressure, forces a mixing of the liquid chemical product 106 at the prescribed ratio by the Venturi effect, which draws the liquid chemical product 106 from the product container 104 through the supply line 136 to the mixing unit 114. The mixture of the liquid chemical product 106 is then dispensed from the corresponding one of the filling nozzles 126, 128, 130, and 132 until the pushbutton is released. The term "pushbutton" as used herein includes pushbutton controls as well as any other type of manual control suitable for activating the valves in the mixing unit 114 and includes, but is not limited to, levers, switches, and knobs.

The supply lines 136 and 138 are passed through holes in the strain relief 158, for example, in a serpentine fashion as shown to relieve strain between the supply lines 136 and 138 and the mixing unit 114 that may occur during replacement of the product container 104.

Inside the mixing unit 114, the liquid solvent 150 is routed to valves that are actuated respectively by the pushbuttons 116, 118, 120, and 122. For example, upon actuation of one of the pushbuttons 116, 118, 120, and 122, water under pressure supplied by the supply line 138 is allowed to flow into a mixing chamber inside the mixing unit 114. The liquid chemical product 106 is drawn from the product container 104 through the supply line 138 by the Venturi effect and is mixed with the water flowing into the mixing chamber. Y-connectors may be used in the supply line 138 to distribute a liquid chemical product to multiple mixing chambers, and check valves may be inserted at appropriate points in the supply line 138 to prevent introducing air and other liquid chemical products into the product containers 104 across the Y-connectors. Each of the multiple mixing chambers may mix the liquid chemical product at a different (or the same) concentration (ratio) with the solvent, e.g., with water.

After mixing, the mixed water and liquid chemical product 106 pass out of the mixing unit 114 through the output lines 134 to the corresponding one of the filling nozzles 126, 128, 130, and 132. The filling nozzles 126, 128, 130, and 132 are preferably rigid metal tubes welded to the hinged faceplate 108 to prevent access to the output lines 134 from outside the tamper proof liquid dispenser 100. This feature prevents, for example, an inmate or vandal from pulling on one of the output lines 134 that may result in damage to the output lines 134 or to the mixing unit 114.

Figure 2:
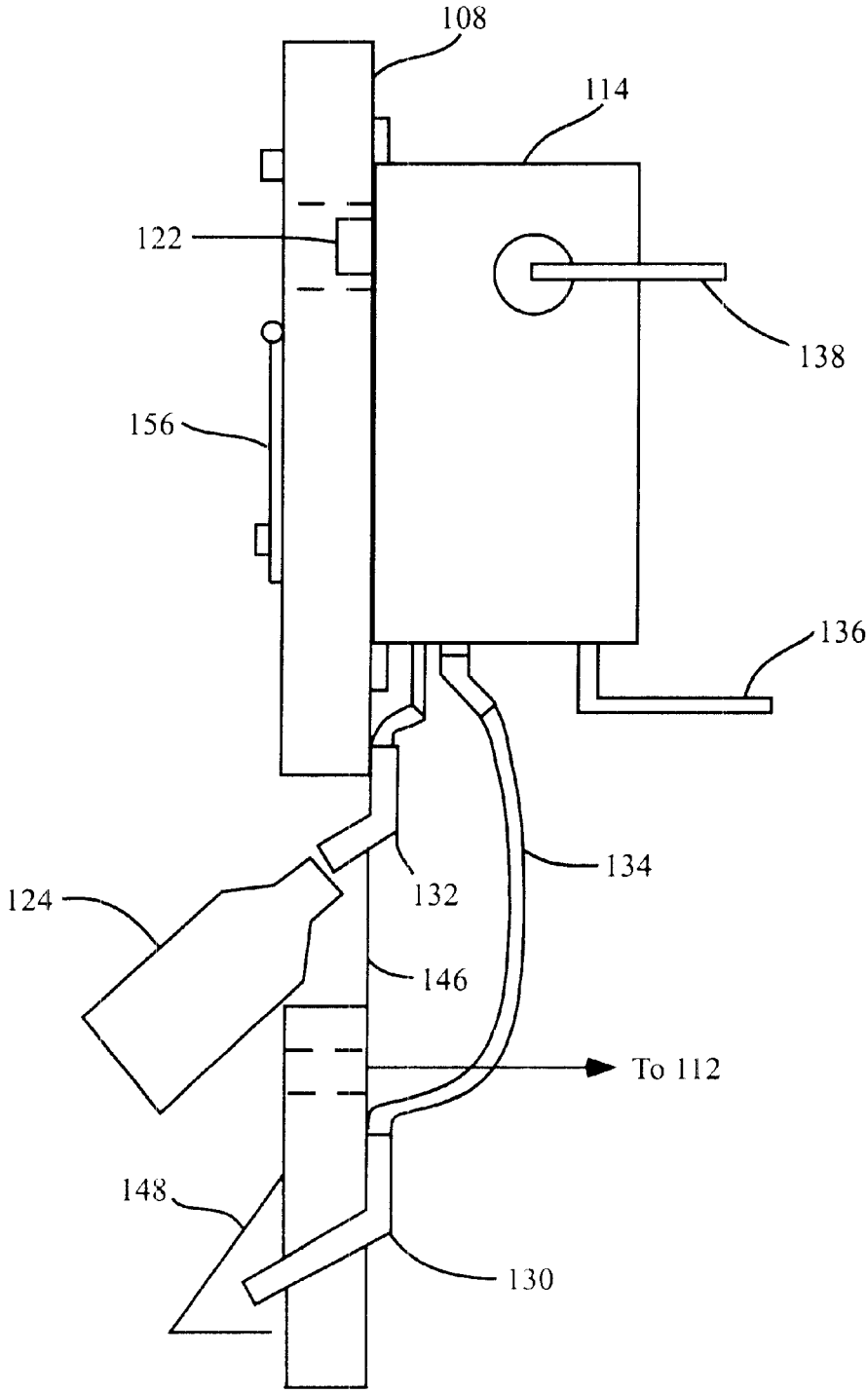
FIG. 2 illustrates a side view of the hinged faceplate of the tamper proof liquid dispenser of FIG. 1.

FIG. 2 illustrates a side view of the hinged faceplate 108 of the tamper proof liquid dispenser 100 of FIG. 1. The mixing unit 114 is conveniently mounted on the inside of the hinged faceplate 108 by flanges as shown or on a bracket so that it swings out of the way with the hinged faceplate 108 during replacement of the product containers 104 inside the cabinet enclosure 102. The locking plate 156 is shown in the open position over the lower clasp to allow access to the recessed pushbutton 122 through the hole in the faceplate 108. The faceplate 108 preferably has double walls to add thickness and strength, and the hole through the faceplate 108 for accessing the recessed pushbutton 122 may be lined with a cylinder around the pushbutton 122. The cylinder may be held in place, for example, by welding the outside wall of the cylinder to the faceplate 108.

The filling nozzle 132 protrudes through the faceplate 108 into the filling recess 146. The filling recess 146 has a width that limits the width of a container that may be placed inside the filling recess 146 so that the top of the container fits under the filling nozzle 132. The filling nozzle 130 protrudes through the lower portion of the faceplate 108 for dispensing a mixture of the liquid chemical product 106 into a mop bucket or other suitable container placed underneath the tamper proof liquid dispenser 100.

Figure 3A:
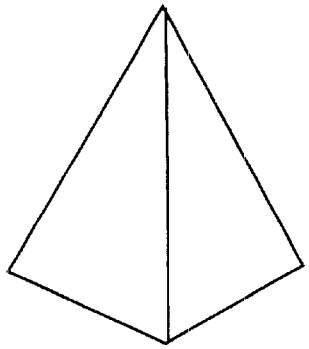
FIGS. 3A, 3B, and 3C illustrate various embodiments of the outlet shield for the tamper proof liquid dispenser of FIG. 1.
Figure 3B:
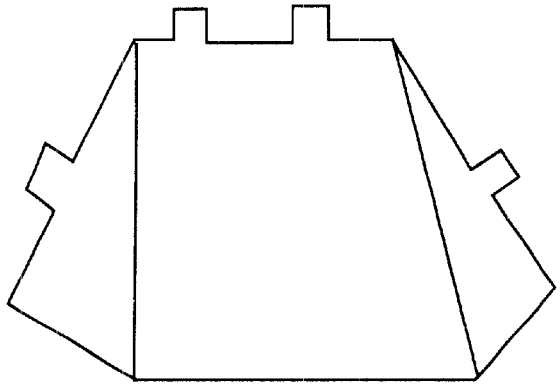
Figure 3C:
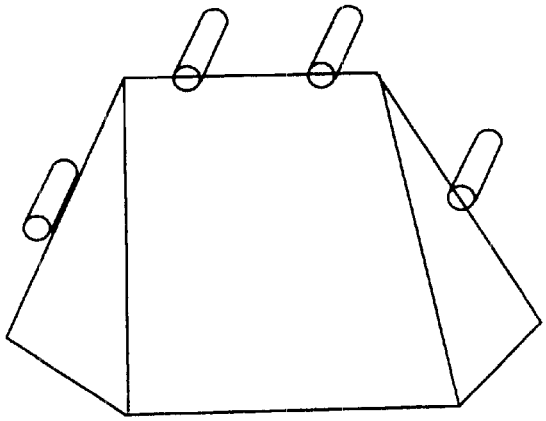

FIGS. 3A, 3B, and 3C illustrate additional embodiments of the outlet shield for the tamper proof liquid dispenser of FIG. 1. The outlet shield is used to protect the filling nozzles from abuse and to prevent misdirecting the flow of the mixture of the liquid chemical product by bending the filling nozzle upward or to the side. In the embodiment illustrated in FIG. 3A, the outlet shield has a pyramidal shape suitable for covering a single filling nozzle. In the embodiments illustrated in FIGS. 3B and 3C, the outlet shield has a trapezoidal shape suitable for covering single or multiple filling nozzles. Three techniques that may be used to fasten the outlet shield are illustrated.

In FIG. 3A, part or all of the upper two edges of the outlet shield facing the faceplate 108 are welded to the faceplate 108. The lower two edges form the opening through which the outlet is accessible.

In FIG. 3B, the outlet shield has tabs protruding from the edge facing the faceplate 108 that fit into corresponding slots formed in the faceplate 108. The tabs may be welded to the faceplate 108 from the front and/or, preferably, the back of the faceplate 108.

In FIG. 3C, the outlet shield has round posts protruding from the edge facing the faceplate 108 that fit into corresponding holes formed in the faceplate 108. The posts may be welded to the faceplate 108 from the front and/or, preferably, the back of the faceplate 108.

Figure 4:
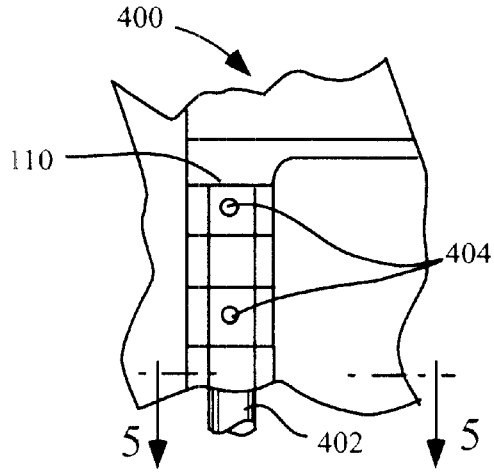
FIGS. 4 and 5 illustrate a side view and a cross-sectional view, respectively, of a portion of the tamper proof hinge for the tamper proof liquid dispenser of FIG. 1.
Figure 5:
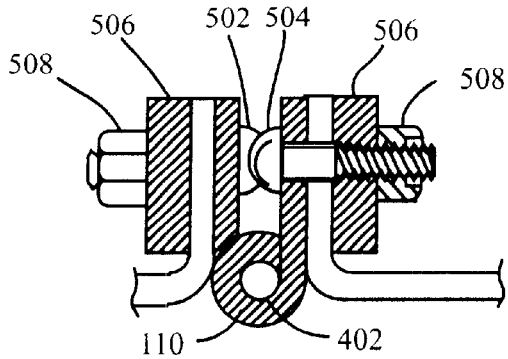

FIGS. 4 and 5 illustrate a side view and a top cross-sectional view, respectively, of a portion of the tamper proof hinge 110 for the tamper proof liquid dispenser 100 of FIG. 1.

FIG. 4 illustrates a side view 400 of a portion of the tamper proof hinge 110. The hinge pin 402 is preferably crimped and/or welded at the top and bottom of the tamper proof hinge 110 to prevent removal of the hinge pin 402. The crimping is done on alternate hinge segments 404 of the hinge. The hinge pin 402 may also be cut into short segments each having a length of, for example, from one to four inches to deter removal of the hinge pin 402 for use as a weapon.

FIG. 5 illustrates a cross-sectional view of a portion of the tamper proof hinge 110. In the embodiment illustrated in FIG. 5, the hinge pin 402 is recessed between the enclosure cabinet 102 and the faceplate 108 so that if the top of the cabinet enclosure 102 is made to overhang the faceplate 108, then the hinge pin 402 cannot clear the top of the cabinet enclosure 102, even if the welds and/or crimps in the hinge segments 404 are loosened.

The tamper proof hinge 110 is fastened to the cabinet enclosure 102 and the faceplate 108 by prison screws 502 and 504 or other fasteners that are difficult to remove. The threaded ends of the prison screws 502 and 504 are fastened to the back of the cabinet enclosure 102 and the faceplate 108 by threaded plates 506 and lock nuts 508. Even if the lock nuts 508 are removed, the threaded plate 506 holds the prison screws 502 and 504 in place, further deterring removal of the tamper proof hinge 110. The threaded plate 506 preferably has a length substantially the same as the length of the hinge.

Figure 6:
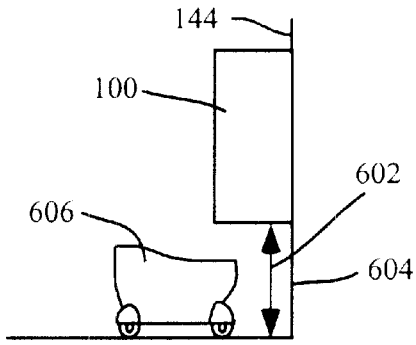
FIG. 6 illustrates a side view of the tamper proof liquid dispenser of FIG. 1 mounted on a wall to limit the height of a container that may be placed underneath for filling according to an embodiment of the present invention.

FIG. 6 illustrates the tamper proof liquid dispenser 100 of FIG. 1 mounted on a wall 604 to limit the height of the container 606 that may be placed underneath the cabinet enclosure 102 for receiving the liquid chemical product 106 dispensed from the mixing unit 114.

In this example, the container 606 is a mop bucket. In addition to a mop bucket, other containers may be used, for example, an auto-scrubber or a vat. Advantageously, the tamper proof liquid dispenser 100 may be mounted on a wall or other suitable surface by the wall mounting brackets 144 in a permanent or semi-permanent fashion at a height 602 barely sufficient to allow clearance for the placement of the container 606 beneath the cabinet enclosure 102. The clearance may be any distance in the range from 2 to 15 centimeters suitable for preventing taller and larger receptacles that are not meant to be filled from the tamper proof liquid dispenser 100. For example, the clearance may be one to two centimeters between the top of the container 606 and the bottom of the cabinet enclosure 102, thus allowing the container 606 to be rolled beneath the tamper proof liquid dispenser 100 to receive a limited amount of the liquid chemical product 106 from either of the filling nozzles 128 and 130 while preventing a taller and larger container from being placed beneath the tamper proof liquid dispenser 100. The low clearance feature prevents, for example, an inmate from dispensing an excessive amount of cleaning product by filling up a larger receptacle than required for the job, such as a large garbage can. Advantageously, this feature reduces the amount of wasted fluid and thus decreases the cost of cleaning.

Figures 7, 8:
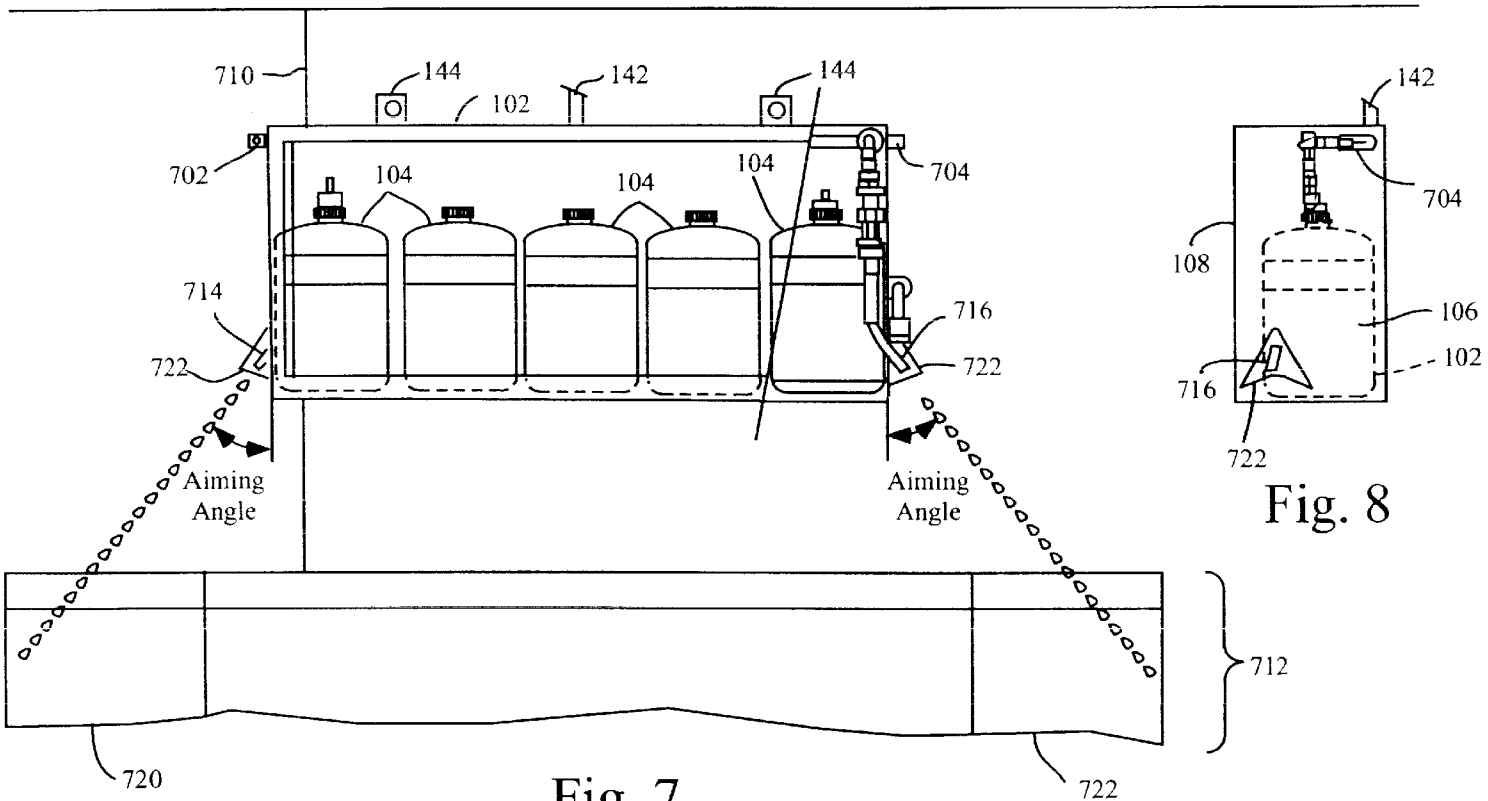
FIGS. 7 and 8 illustrate front and side views of a tamper proof liquid dispenser for use with a triple sink according to an embodiment of the present invention.

FIGS. 7 and 8 illustrate front and side views, respectively, of a tamper proof liquid dispenser according to an embodiment of the present invention for use with a triple sink 412. In FIG. 7, the cabinet enclosure 102 is mounted on a wall 710 by the wall mounting brackets 144 above the triple sink 712. Levers 702 and 704 are used to activate valves for mixing (such as venturi mixing) the liquid chemical products from the product containers 104 and a solvent, for example, water and to dispense the mixture through the filling nozzles 714 and 716 located on each side of the cabinet enclosure 102 above the first and third basins 720 and 722 of the triple sink 712. As an alternative to the levers 702 and 704, rotary valves may be used to mix and dispense the liquid chemical products from the product containers 104. The filling nozzles 714 and 716 may be, for example, rigid steel tubes welded to the hinged faceplate 108. The filling nozzles 714 and 716 are aimed respectively into the first and third basins 720 and 722 of the triple sink 412, for example, by bending them to the correct aiming angle when the cabinet enclosure 102 is mounted on the wall 710 so that the stream from the filling nozzle 714 has the proper aiming angle to fall into the first basin 720, typically the wash basin, and the stream from the filling nozzle 716 has the proper aiming angle to fall into the third basin 720, typically the sterilizer basin. The outlet shields 722 may be constructed in a similar fashion described above with respect to FIGS. 3A, 3B, and 3C to protect the filling nozzles 714 and 716 and to prevent aiming the stream of liquid chemical product and solvent outside a safe range of the stream aiming angles.

FIG. 8 illustrates a side view of the tamper proof liquid dispenser of FIG. 7. The lever 704 on the side of the cabinet enclosure 102 activates a valve connected to one of the product containers 104 to dispense the mixture of the liquid chemical product 106 and the solvent through the filling nozzle 716. The liquid solvent supply 142 is shown at the top of the cabinet enclosure 102.

Figure 9:
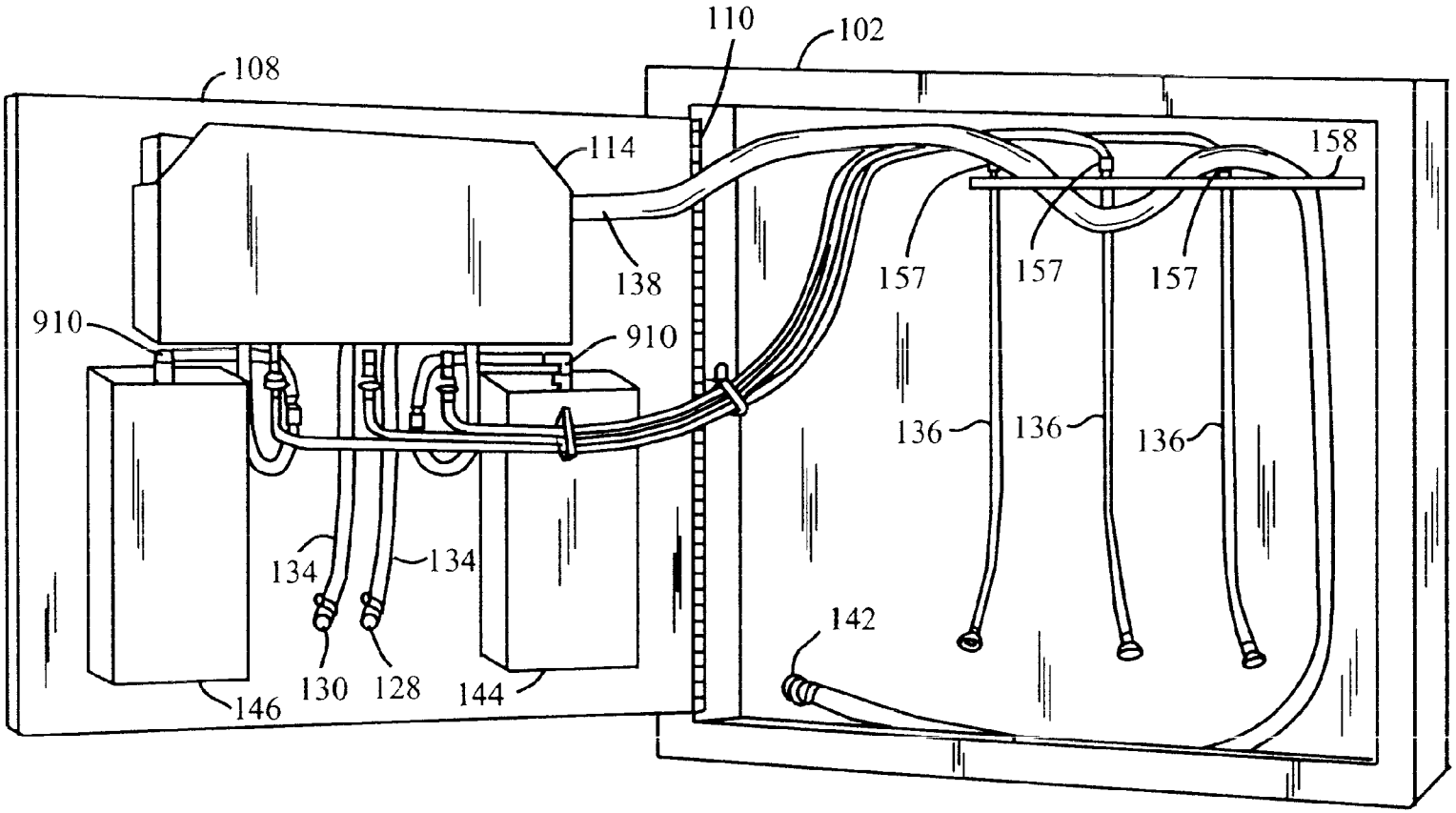
FIG. 9 illustrates a rear view of the hinged faceplate and the cabinet enclosure of a tamper proof liquid dispenser according to an embodiment of the present invention.

FIG. 9 illustrates a rear view of the hinged faceplate and the cabinet enclosure of a tamper proof liquid dispenser according to an embodiment of the present invention. Shown in FIG. 9 are a cabinet enclosure 102, a hinged faceplate 108, a tamper proof hinge 110, a mixing unit 114, filling nozzles 128 and 130, output lines 134, chemical supply lines 136, a solvent supply line 138, and a strain relief 158 similar in structure to those described with reference to FIGS. 1 and 2. The mixing unit 114 is fastened to the back of the hinged faceplate 108 so that the mixing unit 114, the chemical supply lines 136, and the solvent supply line 138 move away from the interior of the cabinet enclosure 102 to provide convenient access to the product containers (not shown) and other interior components inside the cabinet enclosure 102.

In the embodiment illustrated in FIG. 9, the chemical supply lines 136 are strain relieved by the double end barb couplers 157 located just above the strain relief 158. The double end barb couplers 157 expand the ends of the lower section of each of the chemical supply lines 136 so that the upper section leading to the mixing unit 114 may not be pulled through the strain relief 158.

Figure 10:
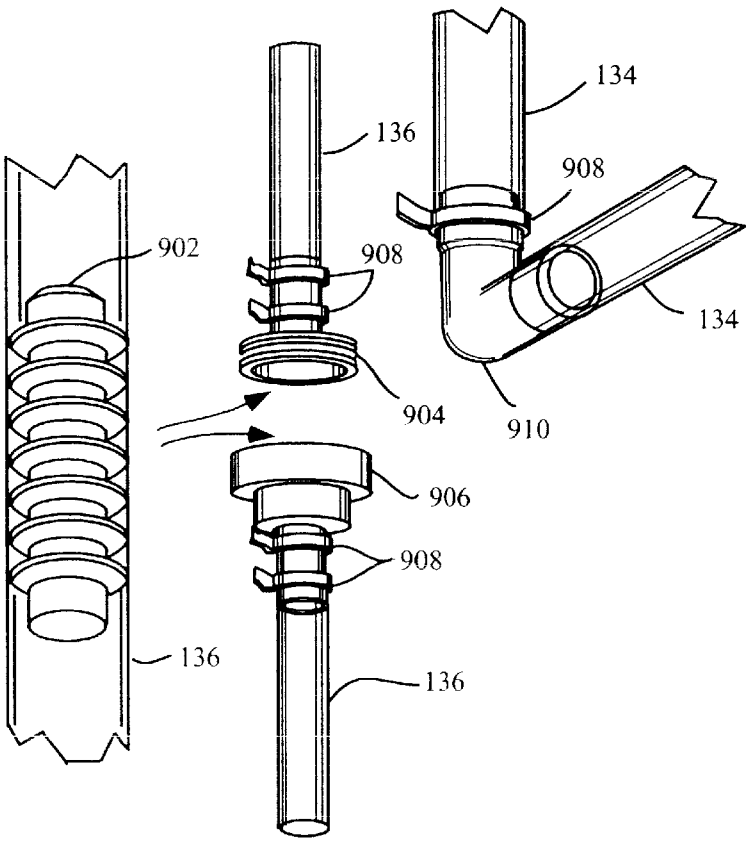
FIG. 10 illustrates an exploded view of a check valve coupler for use with the tamper proof liquid dispenser of FIG. 9.

FIG. 10 illustrates an exploded view of a check valve coupler for the tamper proof liquid dispenser of FIG. 9. Shown in FIG. 10 are a check valve 902, upper sections of a chemical supply line 136, lower sections of the chemical supply line 136, a male connector 904, a female connector 906 that forms a leakproof seal when mated to the male connector 904, nylon ties 908, and a right angle coupler 910. The check valve coupler is inserted into the chemical supply lines 136 to prevent backflow of solvent and other chemical products into the product containers.

A flow tip may be inserted into each of the chemical supply lines 136 to control the respective flow rates of the liquid chemical product 106 through the chemical supply lines 136. Different flow tips having different inside diameters may be used to select a desired solution strength. The diameter and corresponding flow rate of each flow tip may be indicated on the flow tip by color coding the flow tip and/or by marking symbols on the flow tip. The flow tip may be easily removed for cleaning or replacement by opening the hinged faceplate 108 and replacing the flow tip.

The right angle coupler 910 is located at the top of the filling recesses 144 and 146 in the output lines 134. The right angle coupler 910 is preferably secured to the upper section of the output line 134 by a hose clamp, for example, a nylon tie 908, to prevent the right angle coupler 910 from being pulled out of the upper section of the output line 134.

Figure 11:
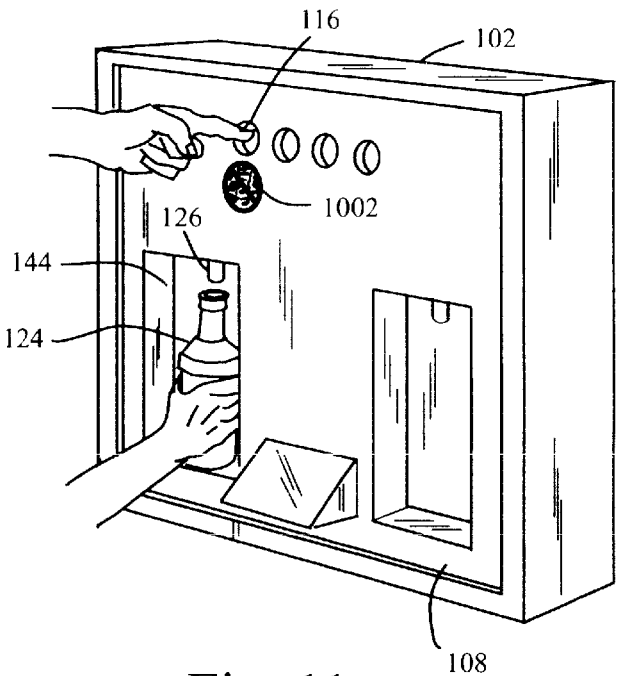
FIG. 11 illustrates dispensing a mixture of a liquid chemical product into a dispensing container from a tamper proof liquid dispenser according to an embodiment of the present invention.

FIG. 11 illustrates dispensing a mixture of a liquid chemical product into a dispensing container 124 from a tamper proof liquid dispenser according to an embodiment of the present invention. The features illustrated in FIG. 11 are similar to those described with reference to FIG. 1, however, some features of FIG. 1 such as the locking plates and clasps have been omitted to simplify the illustration. The dispenser container 124 is placed inside the filling recess 144, and the corresponding pushbutton 116 is depressed to dispense the selected liquid chemical product into the dispenser container 124. In this example, a label 1002 is attached on or near the pushbutton 116 to indicate which liquid chemical product is dispensed from the corresponding filling nozzle 126. A similar or identical label may be attached to the dispenser container 124 to ensure that the proper liquid chemical product is dispensed into the dispenser container 124. The label 1002 may also be color coded according to a corresponding color key used to identify each liquid chemical product.

Figure 12:
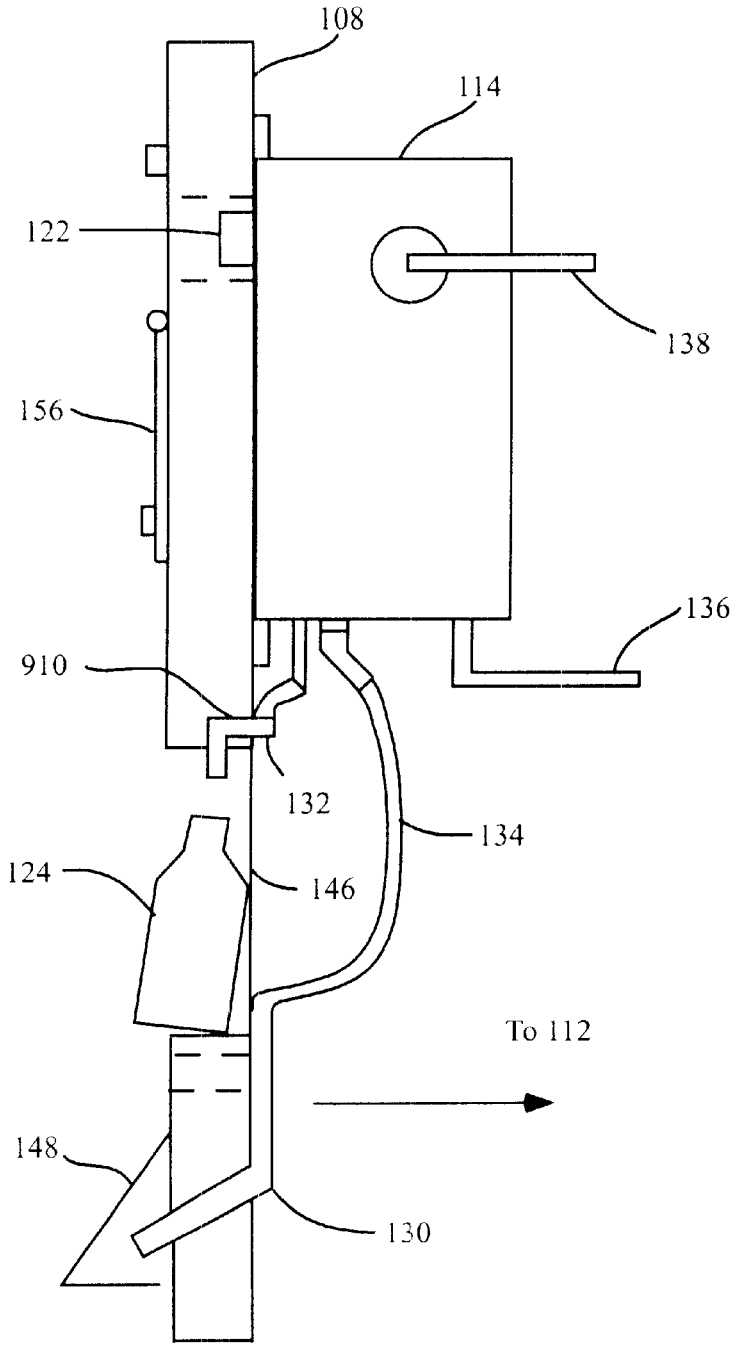
FIG. 12 illustrates a side view of the hinged faceplate of the tamper proof liquid dispenser of FIG. 9.

FIG. 12 illustrates a side view of the hinged faceplate of the tamper proof liquid dispenser of FIG. 9. The description of FIG. 2 also applies to FIG. 12, except that in the arrangement of FIG. 12, the filling recess 146 has a shape that accommodates the appropriate dispenser container 124, and the filling nozzle 132 is aimed directly downward or slightly back toward the faceplate 108 to avoid placing oversize containers underneath the tamper proof liquid dispenser and filling them from the wrong filling nozzle.

As may be appreciated from the description above, no part may be removed from outside of the tamper proof liquid dispenser of the present invention without a specialized tool, such as a screwdriver for prison screws, which is not readily available to unauthorized personnel. The hinged faceplate cannot be manually bent, pried, or kicked open. Chemical concentrate containers inside the cabinet enclosure are protected from puncture, tipping, squeezing, etc. so that they may not be vandalized. The shape of the filling recesses may be customized to allow only the appropriately shaped container to fit under the filling nozzle. The solvent source line is strain relieved by serpentining or by a double end barb coupler so that if pulled on, the internal components of the tamper proof liquid dispenser are not damaged. The filling nozzles are recessed so that they may not be tampered with from outside and may not be bent or turned, for example, so as to spray into eyes. The chemical supply lines are secured with double end barb couplers that do not fit through the strain relief so that they may not be pulled off when replacing the product containers. The pushbuttons may be completely enclosed by cylindrical walls to prevent tampering and may be recessed inside the cylindrical walls or may protrude from the cylindrical walls through the hinged faceplate.

While the invention herein disclosed has been described by means of specific embodiments and applications thereof, numerous modifications and variations could be made thereto by those skilled in the art without departing from the scope of the invention set forth in the following claims.

What is claimed is:

1. A tamper proof apparatus for dispensing a selected liquid comprising:

a cabinet enclosure having an open front for enclosing interior components;

a hinged faceplate covering the open front of the cabinet enclosure;

a mixing unit fastened to an inside surface of the hinged faceplate for mixing the selected liquid in a selected proportion of a liquid chemical product and a liquid solvent;

a filling nozzle coupled to the mixing unit for dispensing the selected liquid into a container;

a pushbutton coupled to the mixing unit through the hinged faceplate for causing the selected liquid to be dispensed from the filling nozzle; and a locking plate that may be detachably coupled to an outside surface of the hinged faceplate for restricting access to the pushbutton.

2. The tamper proof apparatus of claim 1 further comprising a filling recess formed in the hinged faceplate for limiting a dimension of a container placed inside the filling recess so that a top of the container fits under the filling nozzle.

3. The tamper proof apparatus of claim 1 wherein the selected liquid comprises a product concentrate mixed with a solvent in a selected proportion.

4. The tamper proof apparatus of claim 1 wherein the selected liquid comprises one of a plurality of liquid product concentrates stored in product containers inside the cabinet enclosure.

5. The tamper proof apparatus of claim 4 wherein the product containers comprise one of a flexible bladder and a plastic keg.

6. The tamper proof apparatus of claim 1 further comprising a filling nozzle coupled to the mixing unit for dispensing the selected liquid into a container placed underneath the cabinet enclosure and a wall mounting coupled to the cabinet enclosure for mounting the cabinet enclosure at a selected height to limit a height of the container placed underneath the cabinet enclosure.

7. The tamper proof apparatus of claim 6 further comprising an outlet shield coupled to the hinged faceplate for protecting the filling nozzle.

8. The tamper proof apparatus of claim 6 wherein the container is one of a mop bucket, an auto-scrubber, and a vat.

9. The tamper proof apparatus of claim 1 further comprising a supply line coupled to the mixing unit for conducting one of a product concentrate and a solvent to the mixing unit.

10. The tamper proof apparatus of claim 9 further comprising a strain relief coupled to the supply line for relieving strain between the supply line and the mixing unit.

11. The tamper proof apparatus of claim 9 further comprising a product container stored inside the cabinet enclosure and coupled to the supply line.

12. The tamper proof apparatus of claim 9 further comprising a feedthrough for connecting the supply line through the cabinet enclosure to a water supply.

13. The tamper proof apparatus of claim 1 further comprising a faceplate clasp fastened to the cabinet enclosure and a slot formed in the hinged faceplate through which the faceplate clasp can protrude for securing the hinged faceplate to the cabinet enclosure.

14. The tamper proof apparatus of claim 1 wherein no component thereof may be removed from the outside without a specialized tool.

15. The tamper proof apparatus of claim 1 wherein the hinged faceplate may not be manually bent, kicked, or pried open.

16. The tamper proof apparatus of claim 1 further comprising a filling recess formed in the hinged faceplate having a customized shape for allowing only an appropriately shaped dispenser container to fit under the filling nozzle.

17. The tamper proof apparatus of claim 1 wherein the filling nozzle aims directly downward from a rigid tube that may not be manually bent to prevent filling an oversize container.

18. The tamper proof apparatus of claim 1 wherein a chemical supply line for the liquid solvent is strain relieved to prevent damaging components inside the cabinet enclosure if pulled on.

19. The tamper proof apparatus of claim 1 wherein the filling nozzle may not be manually bent or turned.

20. The tamper proof apparatus of claim 1 wherein the filling nozzle is recessed so that they may not be tampered with from the outside.

21. The tamper proof apparatus of claim 1 wherein the pushbutton is enclosed by a cylindrical wall to prevent tampering.

22. A tamper proof apparatus for dispensing a selected liquid comprising:

cabinet enclosure means for enclosing interior components;

faceplate means for covering an opening in the cabinet enclosure means;

mixing unit means coupled to the faceplate means for mixing a selected proportion of a liquid chemical product and a liquid solvent constituting the selected liquid;

filling nozzle means coupled to the mixing unit means for dispensing the selected liquid into a container;

pushbutton means coupled to the mixing unit means for causing the selected liquid to be dispensed from the filling nozzle; and locking plate means detachably coupleable to the faceplate means for restricting access to the pushbutton.

23. The tamper proof apparatus of claim 22 further comprising filling recess means for limiting a dimension of a container that may be placed inside the filling recess so that a top of the container fits under the filling nozzle means.

24. The tamper proof apparatus of claim 22 further comprising filling nozzle means coupled to the mixing unit means for dispensing the selected liquid into a container placed underneath the cabinet enclosure means and wall mounting means coupled to the cabinet enclosure for mounting the cabinet enclosure at a selected height to limit a height of the container placed underneath the cabinet enclosure.

25. The tamper proof apparatus of claim 24 further comprising outlet shield means coupled to the faceplate means for protecting the filling nozzle means.

26. The tamper proof apparatus of claim 22 further comprising supply line means coupled to the mixing unit means for conducting one of a product concentrate and a solvent to the mixing unit means.

27. The tamper proof apparatus of claim 26 further comprising strain relief means coupled to the supply line means for relieving strain between the supply line means and the mixing unit means.

28. The tamper proof apparatus of claim 26 further comprising product container means coupled to the supply line means.

29. The tamper proof apparatus of claim 26 further comprising feedthrough means for connecting the supply line means to a water supply.

30. The tamper proof apparatus of claim 22 further comprising faceplate clasp means for securing the hinged faceplate to the cabinet enclosure.

31. A tamper proof apparatus for dispensing a selected liquid comprising:

a cabinet enclosure having an open front for accessing interior components;

a hinged faceplate covering the open front of the cabinet enclosure;

a mixing unit coupled to the cabinet enclosure;

a filling nozzle coupled to the mixing unit for directing a stream of the selected liquid into a sink basin;

a lever coupled to the mixing unit for causing the selected liquid to be dispensed through the filling nozzle into the sink basin; and a lock coupled to the lever for restricting access to the lever individually.

32. The tamper proof apparatus of claim 31 wherein the filling nozzle may be adjusted to aim the stream of selected liquid into the sink basin.

33. The tamper proof apparatus of claim 31 further comprising an outlet shield coupled to the cabinet enclosure and the filling nozzle.

* * * * *